United States Patent [19]

Kallenbach

[11] Patent Number: 5,014,382

[45] Date of Patent: May 14, 1991

[54] SWIMMING POOL CLEANER

[75] Inventor: Dieter H. F. Kallenbach, Chartwell, South Africa

[73] Assignee: BPH Patent Holding AG, Zug, Switzerland

[21] Appl. No.: 393,536

[22] Filed: Aug. 14, 1989

[30] Foreign Application Priority Data

Aug. 15, 1988 [ZA] South Africa ..... 88/6015
Feb. 13, 1989 [ZA] South Africa ..... 89/1099

[51] Int. Cl.[5] ..... E04H 3/20
[52] U.S. Cl. ..... 15/1.7
[58] Field of Search ..... 15/1.7

[56] References Cited

U.S. PATENT DOCUMENTS 4,023,227 5/1977 Chauvier ..... 15/1.7
4,133,068 1/1979 Hofmann ..... 15/1.7
4,193,156 3/1980 Chauvier ..... 15/1.7
4,351,077 9/1982 Hofmann ..... 15/1.7

*Primary Examiner*—Edward L. Roberts
*Attorney, Agent, or Firm*—Kilpatrick & Cody

[57] ABSTRACT

A swimming pool cleaner comprising a forwardly inclined body having a flow passage therethrough, an inlet foot having a water inlet foot being attached to the body and connected to the flow passage and when in use, is proximate to a surface to be cleaned, a flexible disc surrounding the water inlet and rotatably connected to the inlet foot and having a peripheral edge, and a stop for preventing upward flexing of the peripheral edge beyond a predetermined amount located forward of the body and substantially above and inward of the peripheral edge.

10 Claims, 1 Drawing Sheet

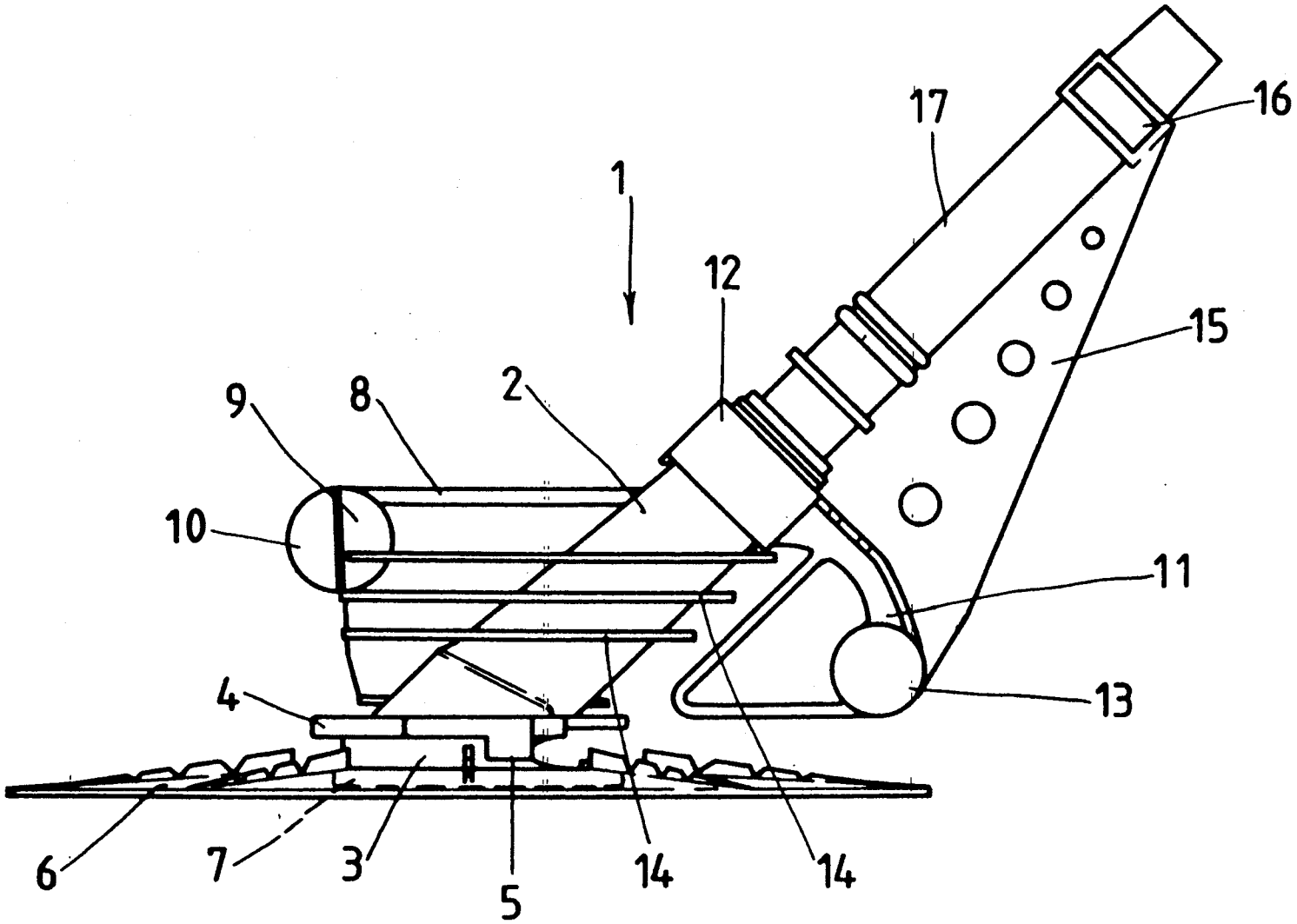
16
15
11
13
17
14
12
14
1
2
5
8
3
9
10
4
7
6

SWIMMING POOL CLEANER

FIELD OF THE INVENTION

This invention relates to swimming pool cleaners of the well known type which comprise an inlet foot having a water inlet proximate, in use, a surface to be cleaned, a flexible disc surrounding the water inlet to assist in holding the foot against the surface to be cleaned, an inclined or transverse flow passage through a body associated with the foot, and means for repeatedly interrupting the flow through the passage in use. In use the repeated interruption of an induced flow of water through the pool cleaner to the conventional filter plant for a swimming pool causes the pool cleaner to move randomly over the surface being cleaned.

BACKGROUND TO THE INVENTION

Pool cleaners of the type referred to have become well known in many countries of the world and one such cleaner is sold under the trade mark "Baracuda". The description of the invention below is directed to a pool cleaner of this type but it is to be understood that it can be made suitable for use with other pool cleaners using a flexible disc and interuption of induced flow through the cleaner to promote movement thereof over a surface to be cleaned.

A pool cleaner of the type referred to moves, in use, in step-wise manner automatically and in random fashion over submerged surfaces to be cleaned and traverses from horizontal surfaces to vertical surfaces and the reverse.

A problem with this type of pool cleaner is, however, the necessity to balance it so that it will remain in an appropriate orientation to the surface being cleaned with the inlet parallel and proximate to surface to be cleaned.

This usually requires one side of the pool cleaner to be weighted and the other side to be provided with a float. Some cleaners include a further movable weight to give directional movement to the cleaner during use.

These factors all increase the weight of the machine and result in a pool cleaner of non-streamlined configuration, both of which result in increased effort being required to move the cleaner over the surfaces to be cleaned.

The effect of the disc on the pool cleaner movement is also such that the disc seriously resists and hinders the movement of the cleaner from horizontal to vertical surfaces and can cause damage where the swimming pool has a liner of vinyl sheet material.

It is the object of the present invention to provide a swimming pool cleaner construction which will at least reduce the disadvantages above referred to.

In the description which follows orientation and directions will relate to the swimming pool cleaner where operatively located for use on a surface to be cleaned.

SUMMARY OF THE INVENTION

According to this invention there is provided a swimminig pool cleaner comprising an inlet foot having a water inlet proximate, in use, to a surface to be cleaned, a flexible disc surrounding the water inlet to assist in holding the foot against the surface to be cleaned, an inclined or transverse flow passage through a body, associated with the foot and a means for repeatedly interrupting the flow through the passage in use. The body and the flow passage therethrough is inclined forward relative to the inlet foot, and the cleaner has a stop located forward of the body a short distance above and inward of the periphery of the flexible disc.

Further features of the invention provide for the stop to include a weight; for the stop to be located on a support member supported from the body; for the support member to be removably mounted on the body and to have a bumper extending upwardly therefrom, and for the axis of the flow passage to extend at about 45 degrees to the surface to be cleaned in the operative position.

The invention also provides for a float to be located above the trailing end of the body and for the float to be located at approximately two thirds of the height of the body above the flexible disc in the instance where the pool cleaner has a body similar to that of the "Baracuda" brand pool cleaner.

Such a float is preferably located in a retainer therefor, part of which is integrally moulded with the body and the trailing section of the surface engaging inlet foot and body is preferably cut back. The weight is retained in a manner similar to the float.

The invention also provides for the weight support member to be attached to the body by the resilient engagement of a ring integral with the member engaging around the outlet from the body.

The bumper for the cleaner is shaped for resilient engagement with the weight support member and, in the case of a pool cleaner such as the "Baracuda" brand, around a rigid extension pipe from the outlet of the body such that the contact surface of the bumper is inclined at an angle of less than forty five degrees preferably about 22 degrees, to the normal to the surface being cleaned.

Other features of this invention will become apparent from the following description of a preferred form of a pool cleaner made according to this invention.

BRIEF DESCRIPTION OF THE DRAWINGS

The accompanying drawing shows a side elevation of a pool cleaner according to the invention.

DETAILED DESCRIPTION OF THE PREFERRED EMBODIMENT

In the embodiment illustrated the cleaner (generally indicated by numeral (1)) is generally of the type sold under the trade mark "Baracuda" insofar as the main opperating mechanism for causing movement of the cleaner is concerned. This construction is more fully described in U.S. Pat. No. 4,642,833 and comprises basically a body 2 having a flow passage therethrough, with an inlet 3 at its end operatively nearer the surface to be cleaned, an inlet foot 4 attached to said inlet 3 of the body, and retaining projections 5 for locating the inner periphery of an annular flexible disc 6 surrounding the mouth of the inlet foot.

The normally used floats and weights have been removed and replaced in accordance with this invention.

The cleaner 1 includes within the body 2 a mechanism (not shown), preferably a special tubular resilient diaphragm (not shown) which flexes, to repreatedly interrupt the flow of water induced through the cleaner during use and thereby cause random movement of the cleaner over a submerged surface to be cleaned.

The cleaner 1 has the axis of the body 2 and flow passage therethrough inclined at about forty five degrees to the surface to be cleaned and extending in the direction of travel of the cleaner.

The body 2 at the inlet is shaped to be releasably engaged by a replaceable wearing foot 4 which, for pools having smooth surfaces of material other than cementitious material, can conveniently be moulded from polypropelene plastics material.

The foot 4 has projections 5 which retain a flexible disc 6 in position around the mouth of the inlet and below an opening (not shown) facing the direction of normal travel of the machine. The disc 6 can rotate around the foot 4.

The surface engaging bottom of the foot 4 is circular except that the trailing section 7 of this part is cut back so that it extends only a short distance behind the inlet 3 to the body. This feature enables the pool cleaner to negotiate intersections between surfaces to be cleaned which meet at fairly sharp angles.

Projecting rearwardly from the upper part of the body 2 is a member 8 terminating in a hollow hemispherical part 9 of a retainer for a suitable float which forms part of the balancing mechanism of the pool cleaner. A hemispherical cap 10 is provided to frictionally engage the part 9 to complete the retainer for the float.

The horizontal axis of the part 9 is located about two thirds of the height of the body 2 above the disc 6 and the retainer is located approximately directly over the trailing edge of the body 2.

Preferably supporting protrusions will be provided inside the retainer so that the float will be held securely in one position therein.

A member 11 to retain a weight in a similar manner to that described for the float is made integral with a resilient split neck member 12. The neck member 12 can engage around the outlet from the body 2 so that the retainer 13 is located a short distance above and adjacent the edge of the disc 6. This retainer 13 also forms a stop and this stop prevents the disc 6 from flexing upwardly relative to the foot by more than a predetermined amount. This flexing can be determined to give the desired results of operation by experiment.

The retainer 13 includes a weight (not shown). This weight has a substantial influence on the movement of the cleaner 1 and because of the leverage provided through the member 11 can be light in comparison with that used in conventional pool cleaners of this type.

The two halves of the retainer 13 are constructed so that they can clip together resiliently to retain the weight.

Fins 14 extend from body 2 and connect part 9 to body 2. Fins 14 act to stabilize body 2 in the lateral direction.

A bumper 15 is provided which is supported from a ring 16 at its upper end and by clip formations at its lower end positioned to clip onto the upper part of the member 11. As shown the ring 16 engages around the upper end of a rigid extension pipe 17 located to project from the outlet from the body 2.

The front edge of the bumper 15 is inclined downwardly and rearwardly, for example, at an angle of between twenty and thirty degrees to the normal of the surface being cleaned. This angle differs appreciably from bumpers of a similar nature previously used with pool cleaners of the type described. The effect of the bumper 15 is that where it contacts an obstruction during the movement of the cleaner 1, bumper 15 assists in lifting the disc 6 from the surface and thus breaking the pressure holding the disc 6 to the surface being traversed. This allows the cleaner 1 to move freely until it disengages from the obstruction.

The cleaner 1 above described can be made of lightweight materials and is operable under low flow rates of water passing through the flow passage. It operates efficiently and quickly and does not cause damage, under normal conditions of use, to vinyl linings used in some pool constructions.

Details of the construction above described can be changed without departing from the scope of the invention. The important factors are the leverage afforded to the float and weight components and restriction of flexing of the forward body edge of the flexible disc 6. The disc 6 itself may also be a type having radially extending ribs from the central opening part-way across the disc 6 and decreasing in height towards the periphery.

What we claim as new and desired to secure by Letters Patent is:

1. A swimming pool cleaner comprising:

(a) a forwardly inclined body having a flow passage therethrough;

(b) an inlet foot having a water inlet, the inlet foot being attached to the body and connected to the flow passage and when in use, is proximate to a surface to be cleaned;

(c) a flexible disc surrounding the water inlet and rotatably connected to the inlet foot and having a peripheral edge; and (d) a stop for preventing upward flexing of the peripheral edge beyond a predetermined amount located forward of the body and above and substantially inward of the peripheral edge.

2. A swimming pool cleaner as claimed in claim 1 in which the stop incorporates a weight and is located on a support member attached to the body.

3. A swimming pool cleaner as claimed in claim 2 in which the support member is removably mounted on the body.

4. A swimming pool cleaner as claimed in claim 2 in which the support member in turn supports, at least in part, a bumper, the leading edge of which is extended downwardly and rearwardly relative to the body.

5. A swimming pool cleaner as claimed in claim 4 in which the bumper is inclined at between twenty and thirty degrees to the normal to the surface being cleaned.

6. A swimming pool cleaner as claimed in claim 2 in which a float is supported away from the body, behind the centerline of the foot, approximately above the trailing edge of the body and substantially horizontal with or above the weight.

7. The swimming pool cleaner of claim 6 wherein the float is supported away from the body at a point approximately two thirds of the height of the body.

8. The swimming pool cleaner of claim 6 wherein the float is located in a retainer which is integrally molded with the body and wherein substantially horizontal fins for stabilizing the pool cleaner extending below the retainer are also integrally molded with the body.

9. A swimming as claimed in claim 2 in which the weight is releasably supported in a retainer which is integrally moulded with the member.

10. A swimming pool cleaner as claimed in claim 1 in which the trailing edge of the inlet foot is cut back across the body.

* * * * *